US009863443B2

(12) United States Patent
Kaupp et al.

(10) Patent No.: US 9,863,443 B2
(45) Date of Patent: Jan. 9, 2018

(54) MULTISTAGE EJECTOR

(71) Applicant: J. SCHMALZ GMBH, Glatten (DE)

(72) Inventors: Stefan Kaupp, Tubingen (DE); Tobias Stahl, Glatten (DE); Walter Dunkmann, Baden-Baden (DE)

(73) Assignee: J. SCHMALZ GMBH, Glatten (DE)

( * ) Notice: Subject to any disclaimer, the term of this patent is extended or adjusted under 35 U.S.C. 154(b) by 293 days.

(21) Appl. No.: 14/327,818

(22) Filed: Jul. 10, 2014

(65) Prior Publication Data

US 2015/0076249 A1 Mar. 19, 2015

(30) Foreign Application Priority Data

Jul. 16, 2013 (DE) ..... 10 2013 107 537

(51) Int. Cl.
*F04F 5/46* (2006.01)
*F04F 5/22* (2006.01)

(52) U.S. Cl.
CPC ..... *F04F 5/467* (2013.01); *F04F 5/22* (2013.01)

(58) Field of Classification Search
CPC ..... F04F 5/12; F04F 5/22; F04F 5/26; F04F 5/461; F04F 5/467; B05B 1/14
USPC ..... 417/151–198; 137/853, 859, 860
See application file for complete search history.

(56) References Cited

U.S. PATENT DOCUMENTS 4,671,263 A * 6/1987 Draenert ..... A61B 17/8802 366/139
5,683,227 A * 11/1997 Nagai ..... F04F 5/22 417/174
6,042,341 A 3/2000 Richter
6,394,760 B1 * 5/2002 Tell ..... F04F 5/467 417/174
8,231,358 B2 * 7/2012 Cho ..... F04F 5/22 417/163

(Continued)

FOREIGN PATENT DOCUMENTS

CN 101002027 A 7/2007
CN 101351649 A 1/2009
DE 4491977 C1 10/1994

(Continued)

OTHER PUBLICATIONS

Examination Report (Including Translation) for corresponding Korean Patent Application No. 10-2014-0089044, dated Oct. 30, 2015.

(Continued)

*Primary Examiner* — Theodore Stigell
*Assistant Examiner* — Chirag Jariwala
(74) *Attorney, Agent, or Firm* — Jason H. Vick; Sheridan Ross, PC

(57) ABSTRACT

A multistage ejector has a nozzle arrangement, which has at least three nozzles which are arranged in series in the direction of a longitudinal axis, wherein the nozzles are designed for passage of a throughflow of a fluid, wherein a fluid gap is provided between adjacent nozzles in each case, wherein at least two of the at least three nozzles are interconnected monolithically to form a nozzle string, and wherein the nozzle string is arranged at least partially in a sleeve and the nozzle string and the sleeve are detachably fastened to each other. The nozzle string and the sleeve are axially fastened to each other by fastening mechanism which acts in a positively locking manner.

20 Claims, 5 Drawing Sheets

(56) References Cited

U.S. PATENT DOCUMENTS

| | | | |
|---|---|---|---|
| 2007/0148009 | A1 | 6/2007 | Cho |
| 2008/0292476 | A1 | 11/2008 | Cho |

FOREIGN PATENT DOCUMENTS

| | | | |
|---|---|---|---|
| DE | 4491977 | | 6/1997 |
| DE | 19850081 | | 5/1999 |
| DE | 19850081 | A1 | 5/1999 |
| EP | 1064464 | B3 | 9/1999 |
| EP | 1969234 | B1 | 7/2007 |
| EP | 1064464 | | 11/2008 |
| EP | 1969234 | | 8/2010 |
| KR | 10-0629994 | | 10/2006 |
| KR | 10-1039470 | B1 | 6/2011 |

OTHER PUBLICATIONS

First Office Action (including translation) for corresponding Chinese Patent Application No. 201410336187.2, dated Dec. 28, 2015.
Examination Report (Including Translation) for corresponding Korean Patent Application No. 10-2014-0089044, dated Jun. 28, 2016.

* cited by examiner

MULTISTAGE EJECTOR

CROSSREFERENCE TO RELATED APPLICATION

This application claims priority from German patent application No. 10 2013 107 537.1 filed on Jul. 16, 2013. The entire contents of this priority application is incorporated herein by reference.

BACKGROUND OF THE INVENTION

The invention relates to multistage ejectors. In particular, the invention relates to multistage ejectors of the type comprising a nozzle arrangement which has at least three nozzles which are arranged in series in the direction of a longitudinal axis.

A multistage ejector of the type referred to in the introduction is used for creating a vacuum or negative pressure. Objects can be lifted, for example, with the negative pressure which is created. For this purpose, the ejector is connected to a corresponding lifting device, wherein the negative pressure which is created by the ejector acts upon a suction gripper by means of which the object is lifted.

In general, the functioning principle of an ejector is based on Bernoulli's law, according to which the static pressure in a flow drops as flow velocity increases. The ejector is operated with a fluid, especially compressed air, as the driving medium which flows at high velocity through the nozzle arrangement. A static negative pressure is thereby created at the fluid gaps between the individual nozzles. This reduced static pressure is used to draw in medium from a space surrounding the ejector—in the case of air being used for lifting—via one or more suction ports in the sleeve of the ejector which communicate with the fluid gaps between the individual nozzles.

When in use, the ejector is installed in an ejector housing, wherein the ejector housing has a bore, the inside diameter of which is matched to the outside diameter of the sleeve so that the sleeve is accommodated in the bore with no clearance. The ejector housing has ports for the feed of fluid as driving medium and ports for drawing in suction medium.

A multistage ejector of the prior art is distributed by the SMC Company under the multistage ejector type designation "ZL 212". This known ejector has in all four nozzles, these being a driver nozzle and three receiver nozzles, as seen in the flow direction of the fluid, wherein all the nozzles are arranged in series in the direction of a longitudinal axis. The three receiver nozzles of this known ejector are interconnected monolithically, i.e. in one piece to form a nozzle string. The nozzle string is accommodated in a sleeve, wherein the nozzle string and the sleeve are detachably fastened to each other.

In the case of the known ejector, the nozzle string and the sleeve are fastened via a frictional engagement which is brought about by means of seals which are arranged on the nozzle string on the outer side and bear against the inner wall of the sleeve with sealing effect.

Now it is necessary from time to time to remove the ejector from the ejector housing for maintenance purposes, wherein to this end the ejector has to be withdrawn from the bore of the ejector housing. Since in the case of the known ejector the nozzle string is only fastened on the sleeve by frictional engagement, it can happen when the ejector is being withdrawn from the ejector housing that only the nozzle string is withdrawn from the sleeve while the sleeve remains fitted in the ejector housing and can then only be removed from the ejector housing by increased manipulating effort. It would admittedly be possible to increase the frictional engagement between the nozzle string and the sleeve so that when the ejector is being withdrawn from the housing the nozzle string is not separated from the sleeve prematurely, but this leads to a more complicated handling of the ejector during its dismantling into nozzle string and sleeve since the separating of the nozzle string from the sleeve is then associated with increased expenditure of effort. The handling- and maintenance friendliness of the known ejector is therefore disadvantageously reduced.

A further multistage ejector is known from EP 1 064 464 B3. In the case of this known ejector, the individual nozzles are provided with connecting means at the ends in each case so that the individual nozzles can be directly interconnected to form a nozzle body. This known ejector does not have a sleeve.

The disadvantage of this known ejector is that the ejector has to be assembled from a large number of individual parts since all the nozzles exist as individual nozzles. Furthermore, as in the case of the previously referred-to known ejector, there is the disadvantage that when the ejector is being withdrawn from the ejector housing the nozzles are separated prematurely from each other and individual nozzles then remain fitted in the housing. Therefore, the handling and the maintenance friendliness are not satisfactory in the case of this known ejector either.

A multistage ejector, in which the nozzle arrangement has a plurality of individual nozzles which are initially retained individually within an inner frame, is known from EP 1 969 234 B1. The inner frame is installed in an outer sleeve and by means of a locking structure the inner frame and the outer frame are fastened to each other in a rotationally secured manner. The disadvantage of this known ejector is in its multipart construction because it has individual nozzles, an inner frame and an outer sleeve so that the construction of this known ejector is very costly. Associated with this, the assembly of this known ejector is also time consuming.

SUMMARY OF THE INVENTION

The invention is based on the object of providing a multistage ejector which has a low number of parts.

The invention is further based on the object to provide a multistage ejector which is handling friendly with regard to its assembly and its installation into, and removal from, an ejector housing.

The invention is further based on the object to provide a multistage ejector which can be maintained without increased cost.

According to an aspect, a multistage ejector is provided, comprising a nozzle arrangement having at least three nozzles arranged in series in a direction of a longitudinal axis. The nozzles are designed for passage of a throughflow of a fluid. A fluid gap is provided between adjacent nozzles. At least two of the at least three nozzles are interconnected monolithically to form a nozzle string. The ejector further comprises a sleeve, the nozzle string being arranged at least partially in the sleeve. The ejector further comprises a fastening mechanism detachably and axially fastening the sleeve and the nozzle string to each other. The fastening mechanism is a positively locking fastening mechanism.

The ejector according to the invention is based on the concept that for economy of individual parts at least two nozzles of the nozzle arrangement are interconnected to form a monolithic nozzle string. This leads not only a lower cost outlay during the production of the ejector but also improves its handling friendliness since at least some of the nozzles do not have to be assembled beforehand. In contrast to the known ejector referred to in the introduction, the nozzle string and the sleeve are axially fastened to each other by means of a fastening mechanism acting in a positively locking manner. The positive locking connection between the nozzle string and the sleeve increases the handling friendliness, especially when the ejector is being removed from an ejector housing, since the axial positive lock between the nozzle string and the sleeve ensures that the nozzle string is not separated from the sleeve prematurely and that the sleeve does not undesirably remain fitted in the bore of the ejector housing when the ejector is being withdrawn but can be completely withdrawn together with the nozzle string. On the other hand, after the removal of the ejector from the ejector housing the nozzle string can easily be separated from the sleeve by disconnecting the positive lock.

The ejector according to the invention, apart from the nozzle string and the sleeve, can have one nozzle, for example the first nozzle (driver nozzle), as seen in the flow direction, as an individual nozzle, and, if necessary, check valves, as are described later. Overall, the ejector according to the invention manages with very few individual parts, however, as a result of which its construction is less costly and its handling is particularly friendly.

The fastening mechanism preferably also fastens the nozzle string and the sleeve to each other in a rotationally secured manner relative to each other.

In this case, it is advantageous that a well-defined rotational position of the nozzle string relative to the sleeve is also maintained.

The fastening mechanism is preferably designed as a plug-in and twist connection, especially as a bayonet connection.

A plug-in and twist connection, especially if it is designed as a bayonet connection, is particularly advantageous with regard to handling friendliness since such a connection can be quickly made and also quickly released again with simple manipulations. For the purposes of the ejector according to the invention, a plug-in and twist connection with a short plug-in travel and short twist travel, which can be less than 45° in the direction of rotation around the longitudinal axis, is sufficient. Furthermore, a plug-in and twist connection, especially a bayonet connection, ensures a secure, axially acting positive lock so that an axially acting force when the ejector is being removed from the ejector housing does not lead to an undesirable, premature separation of the nozzle string from the sleeve.

Alternatively to, or accumulatively with, a plug-in and twist connection, the fastening mechanism is preferably designed as a latching connection.

Therefore, it is possible to additionally design the plug-in and twist connection, especially a bayonet connection, as a latching connection by the nozzle string latching with the sleeve at the end of the rotational travel, for example. This has the advantage that during the assembly of the nozzle string and the sleeve by means of latching, a haptic or acoustic signal is transmitted to the user which indicates that the sleeve and the nozzle string are now reliably fastened to each other in the correct position relative to each other.

Furthermore, the latching connection can ensure that the nozzle string and the sleeve in the assembled state are retained in a rotationally secured manner relative to each other, wherein the force which is to be applied for releasing the latching connection depends on the nature of the latching connection. If a high force is to be necessary for releasing the latching connection, the latching connection can be provided with an operating element, such as a press button, so that the latching connection can only be released after its operation.

Apart from plug-in and twist connections and/or latching connections, other fastening mechanisms, which act in a positively locking manner, such as threaded connections, snap-hook connections, snap-ring connections and the like, are also a possibility within the scope of the invention.

In a further preferred embodiment, the fastening mechanism is arranged on the nozzle string at a distance from one end of said nozzle string so that the nozzle string projects beyond the sleeve.

In this embodiment, the nozzle string therefore projects beyond the end of the sleeve, which has the advantage that when the ejector is being removed from the ejector housing the end of the nozzle string can be gripped by hand in order to withdraw the ejector as a whole from the ejector housing, and for dismantling the ejector into sleeve and nozzle string, the easily accessible end of the nozzle string can be gripped with the one hand and the sleeve can be gripped with the other hand.

In a further preferred embodiment, the fastening mechanism has at least one radially projecting tongue on the nozzle string (34) and at least one recess on the sleeve which recess extends in the direction of the longitudinal axis, and to which recess adjoins a further recess which extends in the circumferential direction around the longitudinal axis.

This embodiment constitutes a constructionally particularly simple design of the fastening mechanism as a plug-in and twist connection, especially as a bayonet connection. The recess on the sleeve which extends in the longitudinal direction of the longitudinal axis can be formed as a groove on the inner side of the sleeve, and the recess on the sleeve which adjoins it in the circumferential direction around the longitudinal axis can be formed as an opening in the wall of the sleeve, as a result of which a latching connection is created in addition to the bayonet connection by the radially projecting tongue on the nozzle string latching into the opening when the nozzle string is rotated relative to the sleeve.

In a further preferred embodiment, the nozzle string has a flange which comes to lie against an end face of the sleeve when the nozzle string is being connected to the sleeve.

The flange, which is preferably designed as radial annular flange, on the nozzle string therefore acts as a stop which abuts against the end face of the sleeve when the nozzle string is being inserted into the sleeve and therefore effects a well-defined axial relative position between the nozzle string and the sleeve. Also, this increases the handling friendliness of the ejector since the flange prevents an excessively deep insertion of the nozzle string into the sleeve.

In a further preferred embodiment, the sleeve has at least one radial opening, wherein at least one check valve for closing and freeing the opening is detachably arranged on the nozzle string between said nozzle string and the sleeve, wherein the check valve on the nozzle string is secured against rotation around the longitudinal axis and/or against displacement in the direction of the longitudinal axis relative to the nozzle string.

Such check valves are known per se in ejectors. The detachability of the at least one check valve improves the maintenance friendliness of the ejector since the check valve can easily be exchanged for a new check valve in the event of wear. Since, as a result of the detachability of the check valve, this is to a greater or lesser extent detachably arranged between the sleeve and the nozzle string, the measure of resistance to rotation and/or to displacement relative the nozzle string has the advantage that the axial position and the rotational position of the check valve is, and remains, well-defined. Particularly in conjunction with the above-mentioned measure—according to which the sleeve and the nozzle string are fastened to each other via a plug-in and twist connection—this measure has the advantage that the check valve does not lose its predetermined position and orientation when the nozzle string is being axially inserted into the sleeve and when the nozzle string is being rotated relative to the sleeve.

In a constructionally particularly simple embodiment of the aforementioned measure, the at least one check valve has a partially circumferentially extending ring, wherein the nozzle string has a seat for the rotationally secured and/or axially secured accommodation of the ring.

The check valve for closing and freeing of the at least one opening in the sleeve can have a slotted annular band which extends in the circumferential direction around the longitudinal axis and which via an axial tab, which can be of thin construction, is connected monolithically to the ring. The ring can also be of thin construction in the axial direction. The seat on the nozzle string for location of the ring can be formed by two axially spaced apart flanges on the outer side of the nozzle body, wherein a radial tongue, against which the free ends of the partially circumferentially extending ring can abut on both sides for preventing rotation of the check valve, can project between the two flanges.

In a further preferred embodiment, the at least three nozzles feature one driver nozzle and at least two receiver nozzles, wherein the at least two receiver nozzles form the monolithic nozzle string.

Although it is possible within the scope of the invention to design the driver nozzle with at least one of the receiver nozzles as a monolithic nozzle string, the aforesaid measure has the advantage that the driver nozzle can be designed as an exchangeable part. In this type of construction, the driver nozzle can also be produced from metal, whereas the monolithic receiver nozzle string can be produced as an inexpensive plastic part.

By the same token, the nozzle arrangement preferably has at least four nozzles which feature one driver nozzle and at least three receiver nozzles, wherein the at least three receiver nozzles form the monolithic nozzle string.

Therefore, it is possible to produce the ejector with nozzle strings according to the invention with a different number of receiver nozzles.

Further features and advantages come from the following description and from the attached drawing.

It is understood that the aforesaid and subsequently still to be explained features can be applied not only in the respectively specified combination but also in other combinations or in isolation without departing from the scope of the present invention.

BRIEF DESCRIPTION OF THE DRAWINGS

An exemplary embodiment is shown in the drawings and is described in more detail in the following with reference to the drawings. In the drawings.

DESCRIPTION OF A PREFERRED EXAMPLARY EMBODIMENT

Figure 1A:
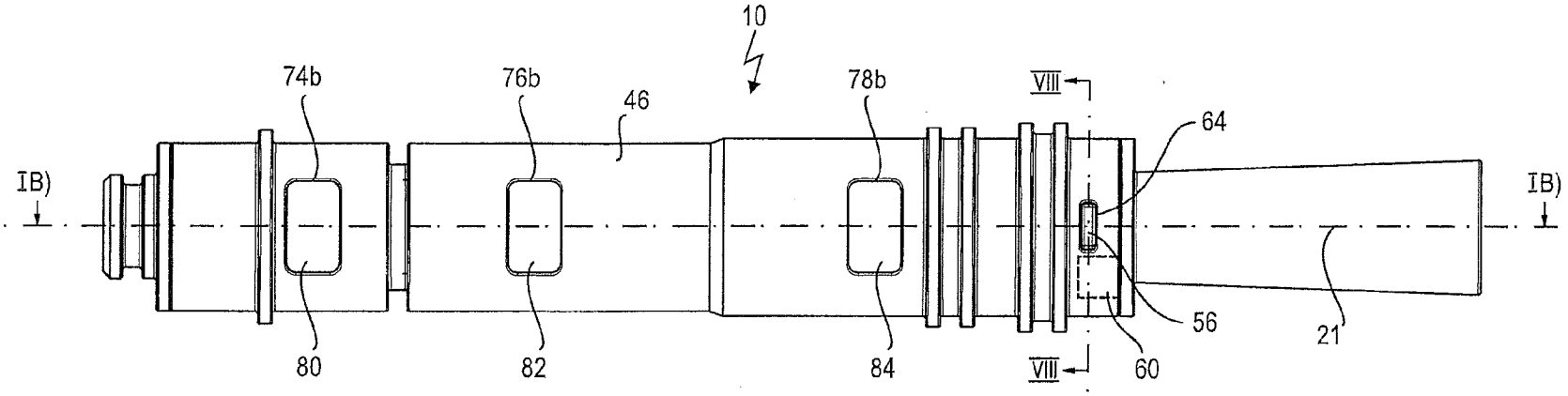
FIG. 1*a* is a side elevation view of a multistage ejector according to an embodiment of the present invention.
Figure 2A:
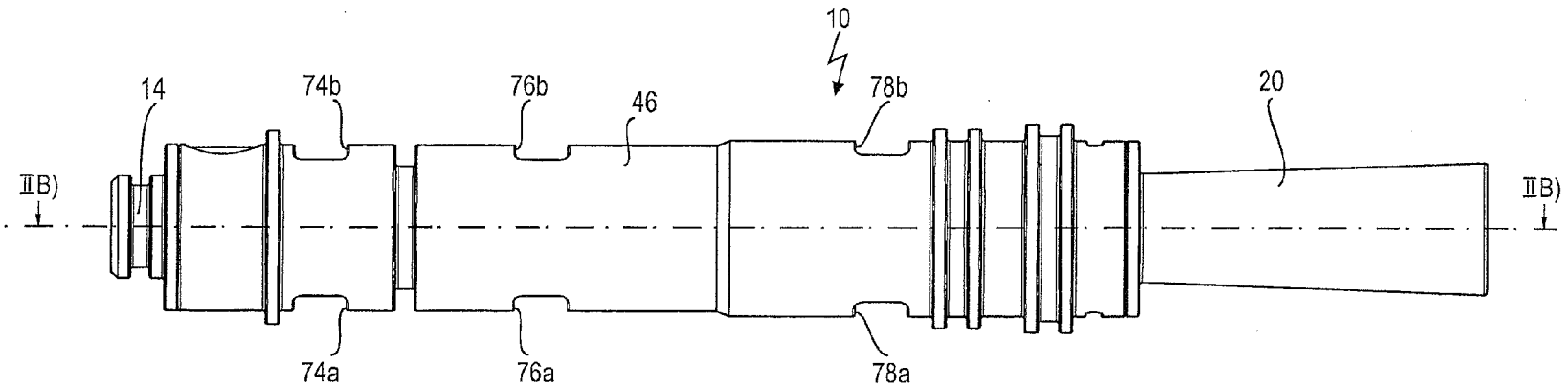
FIG. 2*a* is a side elevation view of the multistage ejector according to the embodiment of FIG. 1*a* and rotated 90 degrees about its longitudinal axis with respect to FIG. 1*a;*
Figure 2B:
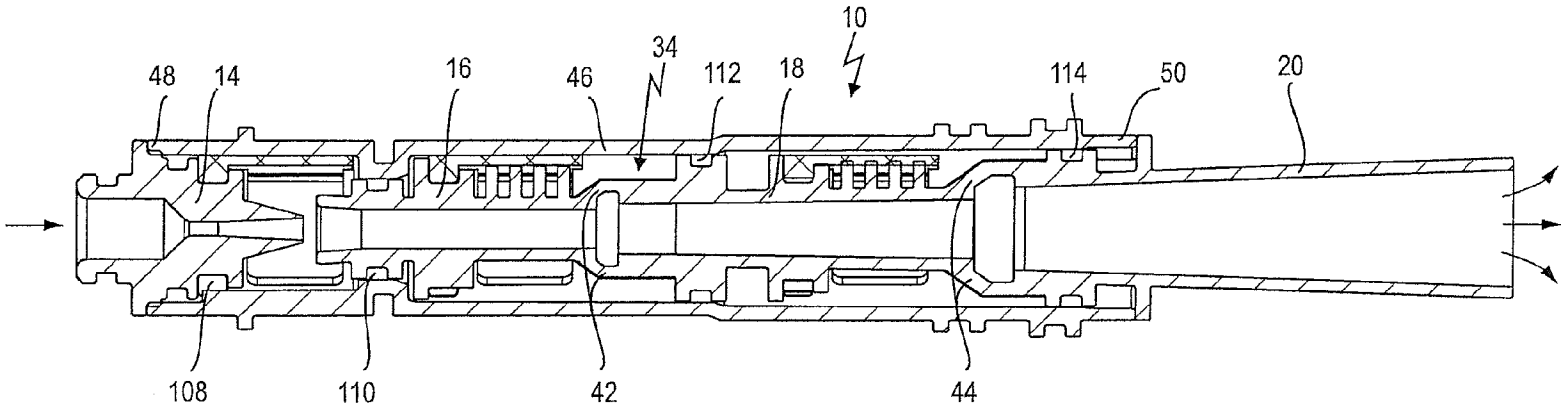
FIG. 2*b* is a cross-sectional elevation view of the embodiment of FIG. 2*a* and taken along line IIB-IIB of FIG. 2*a;*

Shown in FIGS. 1*a*) and *b*) and also in FIGS. 2*a*) and *b*) is a multistage ejector which is provided with the general reference numeral 10. Further details of the ejector 10 are apparent from FIGS. 3 to 8.

The ejector 10 is used for creating a negative pressure or vacuum.

The ejector 10 has a nozzle arrangement 12 with altogether four nozzles 14, 16, 18 and 20 in the depicted exemplary embodiment. The nozzles 14, 16, 18 and 20 are arranged in series in the direction of a longitudinal axis 21.

Figure 1B:
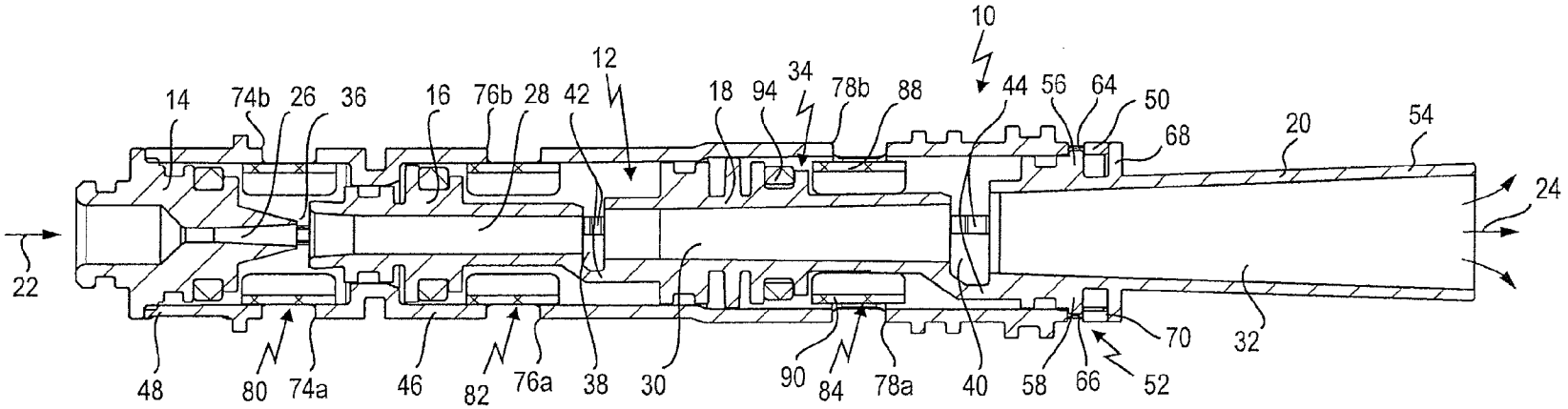
FIG. 1*b* is a cross-sectional elevation view of the embodiment of FIG. 1*a* and taken along line IB-IB of FIG. 1*a;*

The nozzles 14, 16, 18 and 20 are designed for passage of a throughflow of a fluid, especially compressed air. In FIGS. 1*b*) and 2*b*), the fluid flow is indicated by an arrow 22 on the inlet side and by arrows 24 on the outlet side.

The nozzle 14 forms the driver nozzle, and the nozzles 16, 18 and 20 form the receiver nozzles, as seen in the flow direction of the fluid. The nozzle 14 according to FIG. 1*a*) has a fluid passage 26, the nozzle 16 has a fluid passage 28, the nozzle 18 has a fluid passage 30 and the nozzle 20 has a fluid passage 32. In this case, a cross section of the fluid passage 28 is larger than a cross section of the fluid passage 26, and the fluid passage 30 has a larger cross section than the fluid passage 28, and the fluid passage 32 has a larger cross section than the fluid passage 30.

The nozzles 16, 18, 20 are interconnected monolithically to form a one-piece nozzle string 34. The nozzle 14 is designed as an individual nozzle.

Figure 6:
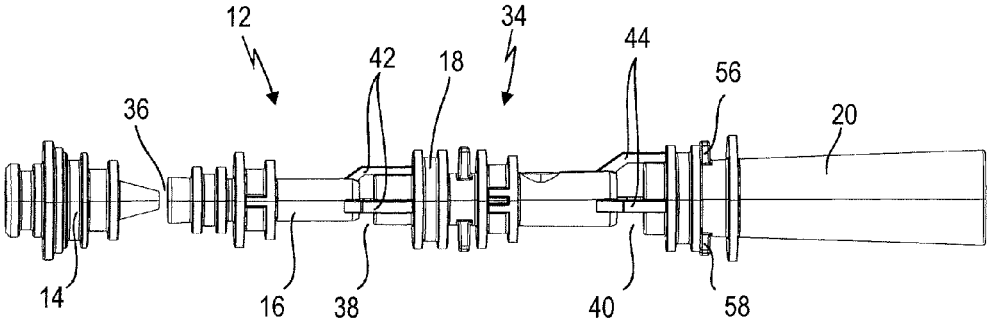
FIG. 6 is a side elevation view of a multistage ejector according one embodiment of the present invention.

Shown in FIG. 6 is the nozzle arrangement 12 with the nozzle string 34 and the nozzle 14 alone.

The nozzle string 34 is produced as a whole in one piece from plastic. The nozzle 14 is produced from aluminium, for example.

The nozzles 14, 16, 18 and 20 according to FIG. 1*a*) and FIG. 6 in each case leave a fluid gap free between each other, specifically a fluid gap 36 between the nozzle 14 and the nozzle 16, a fluid gap 38 between the nozzle 16 and the nozzle 18 and also a fluid gap 40 between the nozzle 18 and the nozzle 20.

In order to realize on the one hand the monolithic connection of the nozzles 16, 18 and 20, and on the other hand the fluid gaps 38 and 40 on the nozzle string 34, the nozzle 16 is connected monolithically to the nozzle 18 via a multiplicity of—in this case three—narrow, axial bridges 42, and the nozzle 18 is connected monolithically to the nozzle 20 via narrow, axial bridges 44. The bridges 42 or 44 are distributed around the longitudinal axis 21 and ensure a sufficiently large opening cross section of the fluid gaps 38 and 40.

The nozzle 14 and also the nozzle string 34 with the nozzles 16, 18 and 20 are accommodated at least partially in a totally monolithic, i.e. one-piece sleeve. The sleeve 46 has a first end 48 in the region of the nozzle 14 and a second end 50 in the region of the nozzle 20. The nozzle 20 projects beyond the second end 50 of the sleeve 46 in this case.

The nozzle string 34 and the sleeve 46, according to FIGS. 1*a*) and *b*) and also FIGS. 2*a*) and *b*), are fastened to each other axially, that is to say in the direction of the longitudinal axis 21, and around the longitudinal axis 21 in the rotational direction, by means of a fastening mechanism 52 which acts in a positively locking manner. The fastening mechanism is also described below with reference to FIG. 8.

The fastening mechanism 52 is arranged on the sleeve 46 on the end side, specifically in the region of the second end 50, whereas the fastening mechanism 52 is arranged on the nozzle string 34 at a distance from one end 54 of said nozzle string 34.

The fastening mechanism 52 is designed as a plug-in and twist connection, especially as a bayonet connection. To this end, the fastening mechanism 52 has two radially projecting tongues 56 and 58 (see FIG. 1*b*) on the nozzle string 34, which extend partially circumferentially around the longitudinal axis 21. The tongues 56 and 58 are offset in relation to each other by 180° around the longitudinal axis 21. The tongues 56 and 58 have radial surfaces 57 and 59 which are curved, but with an eccentricity with regard to the longitudinal axis 21. In this way, the surfaces 57 and 59 act as lead-in bevels when closing the fastening mechanism 52 if the nozzle string 34 is rotated relative to the sleeve 46.

The fastening mechanism 52 furthermore has two recesses 60 and 62, extending in the direction of the longitudinal axis 21, which are formed as grooves on the inner side of the sleeve 46. The recesses 60 and 62 have an extent in the circumferential direction around the longitudinal axis 21 which is slightly larger than the circumferential extent of the tongues 56 and 58 on the nozzle string 34. The axial extent of the recesses 60 and 62 is indicated in FIG. 1*a*) with broken lines for the recess 60. The recesses 60 and 62 are open towards the outermost end of the end 50 of the sleeve 46.

A further recess 64 adjoins the axial recess 60 in the circumferential direction around the longitudinal axis 21, and a further recess 66 adjoins the axial recess 62 in the same rotational direction. The recesses 64 and 66 are formed as radial openings in the sleeve 46 which are set back in relation to the second end 50. In the fastened-together state of the nozzle string 34 and the sleeve 46, the radial tongues 56 and 58 engage in the recesses 64 and 66. The radial tongues 56 and 58 have a slightly greater radial extent than where it corresponds to the inside diameter of the sleeve 46 in the region of the second end 50 so that the radial tongues 56 and 58 can latch into the recesses 64 and 66. The fastening mechanism 52 is therefore not only designed as a plug-in and twist connection in the form of a bayonet connection, but additionally also as a latch-in connection.

The nozzle string 34, by means of the fastening mechanism 52, can therefore be fastened axially on the sleeve 46 and in the rotational direction around the longitudinal axis 21.

The nozzle string 34 has a flange 68 at a distance from its end 54, which in this case is formed as a fully circumferentially extending, radially projecting annular flange which comes to lie against an end face 70 of the sleeve 46 when the nozzle string 34 and the sleeve 46 are being fastened to each other. The flange 68 therefore limits the insertion depth of the nozzle string 34 into the sleeve 46.

Figure 3:
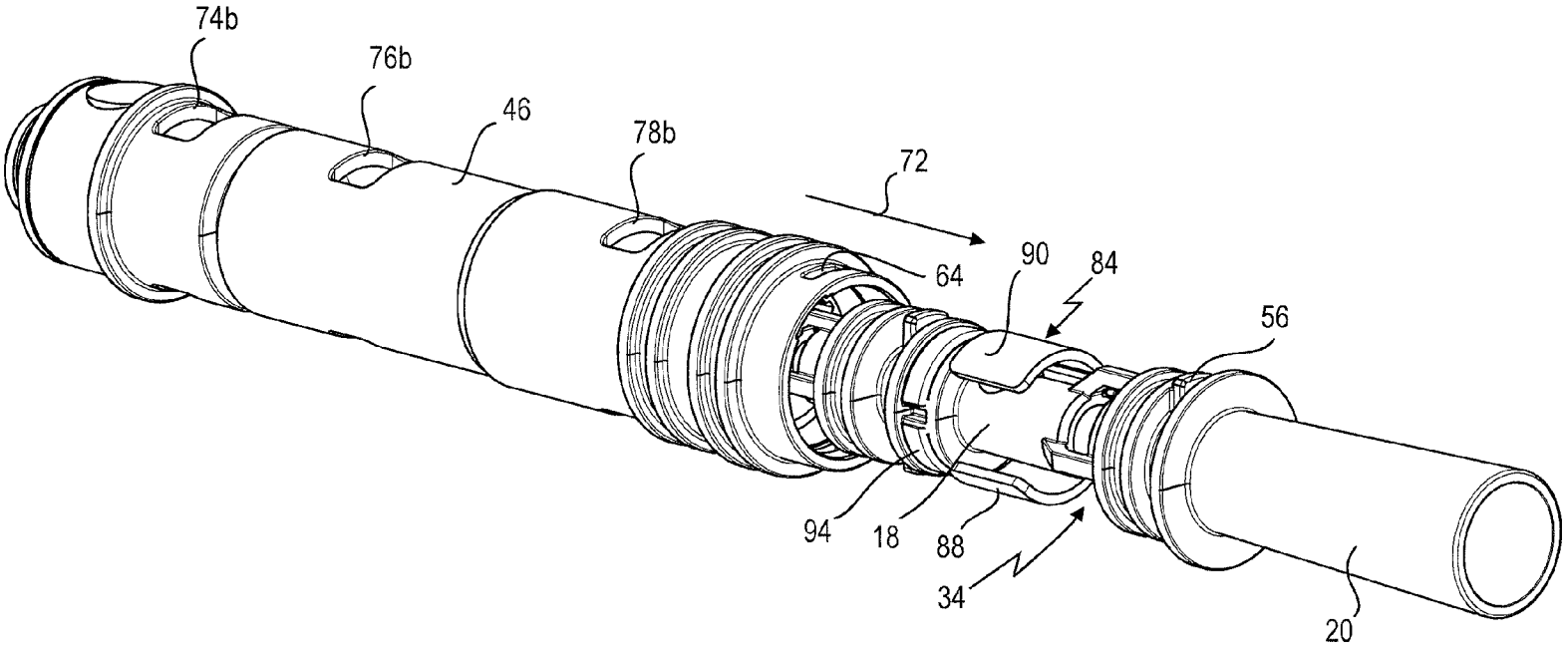
FIG. 3 is a perspective view of a multistage ejector according to the embodiment of FIG. 1*a* and wherein a nozzle string and a sleeve are partially separated from each other.
Figure 8:
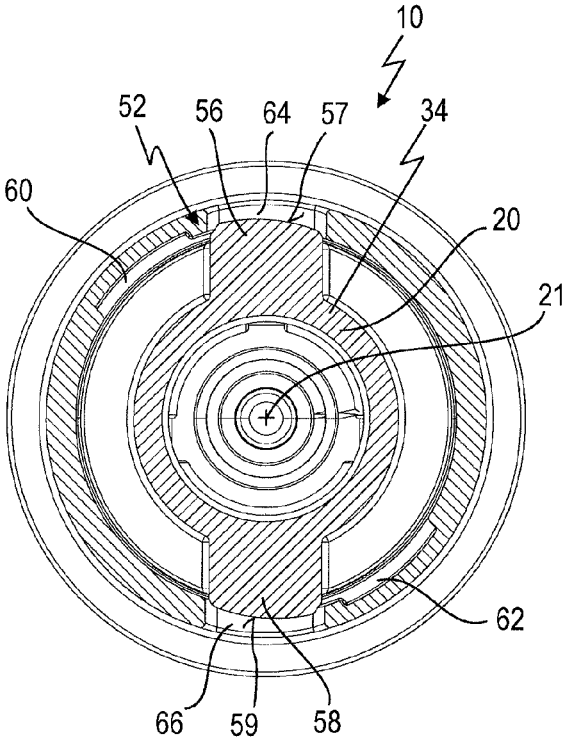
FIG. 8 is an elevation view of the ejector of the embodiment of FIG. 1*a* taken at line VII-VII of FIG. 1*a*.

FIGS. 1*a*) and *b*) and also FIGS. 2*a*) and *b*) and FIG. 8 show the ejector 10 in a state in which the nozzle string 34 and the sleeve 46 are fastened to each other by means of the fastening mechanism 52. For releasing the nozzle string 34 from the sleeve 46, starting from the position in FIG. 8, the nozzle string 34 is first of all rotated anticlockwise around the longitudinal axis 21 relative to the sleeve 46, as a result of which the radial tongues 56 and 58 disengage from the recesses 64 and 66. In the process, the radial tongues 56 and 58 enter the axial recesses 60 and 62. The rotational travel of the nozzle string 34 relative to the sleeve 46 which is required for this is approximately 40°, but at least less than 45°. After the previously described rotation of the nozzle string 34 relative to the sleeve 46, the nozzle string 34 can be fully withdrawn from the sleeve 46, as is indicated in FIG. 3 by an arrow 72. The assembling of the injector 10, that is to say the connecting of the nozzle string 34 to the sleeve 46, is carried out in reverse sequence, that is to say the nozzle string 34 is first of all inserted into the sleeve 46, specifically in a relative rotational position to the sleeve 46, in which the radial tongues 56 and 58 can enter the axial recesses 60 and 62. When the flange 68 abuts against the end face 70, the nozzle string 34 is rotated clockwise (FIG. 8) relative to the sleeve 46 until the radial tongues 56 and 58 engage with the recesses 64 and 66. The bevelled surfaces 57 and 59 of the tongues 56 and 58 reduce the expenditure of force during the rotation and ensure a distinctly perceptible latching of the tongues 56 and 58 into the recesses 64 and 66 by the leading end of the tongues 56 and 58, during the rotation of the nozzle string 34 for the closing of the fastening mechanism 52, having a smaller radial extent than the trailing end.

The sleeve 46 furthermore has a plurality of—in this case six—radial openings 74*a*, 74*b*, 76*a*, 76*b*, 78*a* and 78*b* which enable communication of the inside of the sleeve 46 with its outside. For the freeing and closing of the openings 74*a, b*; 76*a, b* and 78*a, b*, provision is made for check valves 80, 82 and 84, of which the check valves 82 and 84 are connected to the nozzle string 34, whereas the check valve 80 is connected to the nozzle 14. The check valves 82 and 84 are detachably connected to the nozzle string 34 and the check valve 80 is detachably connected to the nozzle 14. The check valves 80, 82 and 84 can therefore be removed from the nozzle 14 or from the nozzle string 34 for the purpose of exchange in the event of wear.

Figure 7:
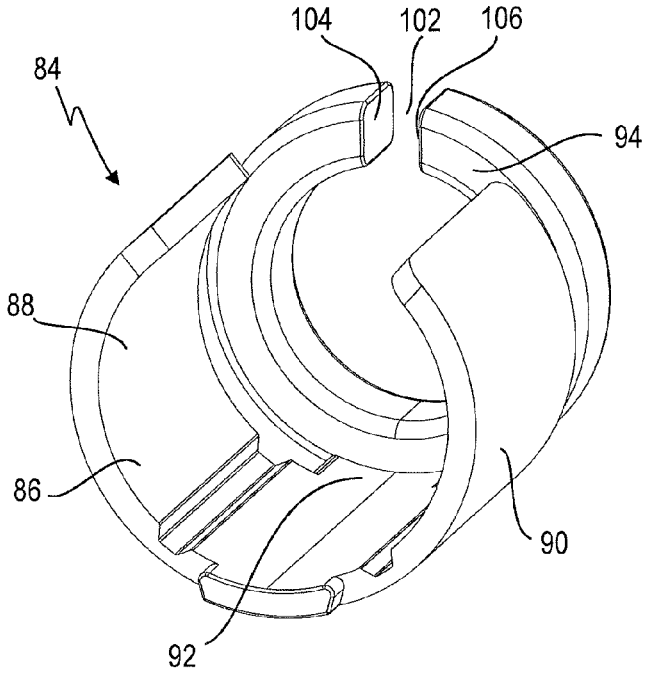
FIG. 7 is a perspective view of a check valve according to one embodiment of the present invention.

The embodiment of the check valves is described below inter alia with reference to FIGS. 4 and 5 and also FIG. 7. FIG. 7 shows the check valve 84 on its own by way of example. The same description also applies to the two other check valves 80 and 82.

The check valve 84, which overall is produced from an elastomer or rubber, has a slotted annular band 86 which on account of its circumferential discontinuity forms two wings 88 and 90. In the state attached on the nozzle string 34, the wing 88 serves for closing the opening 78*b* and the wing 90 serves for closing the opening 78*a* of the sleeve 46.

The annular band 86 is connected monolithically via an axial tab 92 to a partially circumferentially extending or discontinuous ring 94.

As is described below with reference to the check valve 84, the check valves 80, 82 and 84 on the nozzle 14 or on the nozzle string 34 are secured against rotation around the longitudinal axis 21 and against displacement in the direction of the longitudinal axis 21 relative to the nozzle 14 or to the nozzle string 34.

Figure 4:
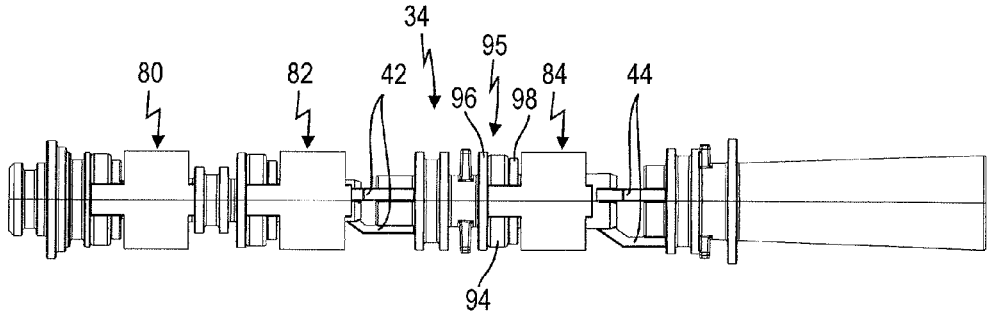
FIG. 4 is a side elevation view of a multistage ejector according one embodiment of the present invention.
Figure 5:
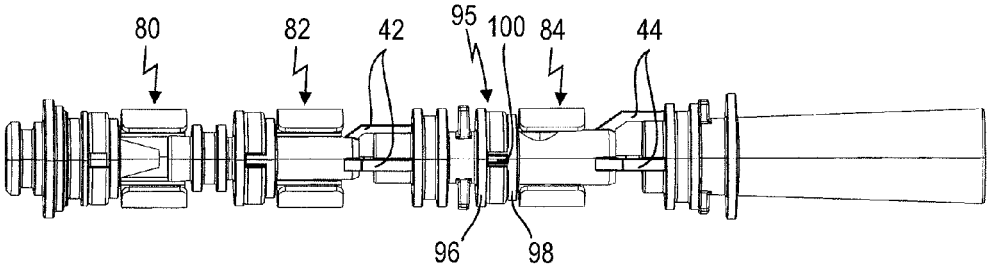
FIG. 5 is a side elevation of the multistage ejector of the embodiment of FIG. 4 wherein the ejector is rotated 180 degrees about the longitudinal axis with respect to FIG. 4.

To this end, for the check valve 84 according to FIG. 4 a seat 95 is formed on the nozzle string 34 and is formed by two radial flanges 96 and 98 which are designed as fully circumferentially extending annular flanges and the spacing of which corresponds to the thickness of the ring 94. The ring 94 is inserted between the two flanges 96 and 98 when the check valve 84 is being attached to the nozzle string 34. The check valve 84 is therefore axially secured against displacement between the flanges 96 and 98. The seat 95 also has a radial tongue 100 between the two flanges 96 and 98 which defines the rotational position of the check valve 84 relative to the nozzle string 34 with regard to the longitudinal axis 21 and, via the fastening mechanism 52, relative to the openings 78*a* and 78*b* and also secures the check valve 84 against rotation around the longitudinal axis 21 relative to the nozzle string 34. For this, the check valve 84 is attached to the nozzle string 34 so that a slotted region 102 of the ring 94 comes to lie level with the tongue 100 so that the two ends 104 and 106 of the ring 94 are supported on both sides of the tongue 100.

When the ejector 10 is being assembled, the check valves 82 and 84 are first of all attached to the nozzle string 34 in the predetermined axial position and rotational position. The nozzle string 34 is then inserted into the sleeve 46, wherein as a result of the axial securing of the check valves 82 and 84 on the nozzle string 34 these cannot be axially displaced relative to the nozzle string 34 when the nozzle string 34 is being inserted into the sleeve 46. With subsequent rotation of the nozzle string 34 relative to the sleeve 46 for the closing of the fastening mechanism 52, the rotational securing of the check valves 82 and 84 on the nozzle string 34 prevents an undesirable rotation of the check valves 82 and 84 relative to the nozzle string 34.

The nozzles 14, 16, 18 and 20 also have slots or seats 108, 110, 112 and 114 for the location of an O-ring in each case (omitted in the drawing) in order to seal the nozzles 14, 16, 18 and 20 in sections against the sleeve 46.

When in use, the ejector 10 is inserted into an ejector housing—not shown—which has a bore which is correspondingly matched to the outside diameter of the sleeve 46. If the ejector 10 has to be withdrawn from the ejector housing for maintenance purposes, the previously described fastening mechanism 52, via which the nozzle string 34 and the sleeve 46 are fastened to each other, prevents the nozzle string 34 from being prematurely released from the sleeve 46 when an axial tensile force is being exerted upon the nozzle string 34 and prevents just the nozzle string 34 from being withdrawn from the ejector housing while the sleeve 46 remains fitted in the ejector housing. On the other hand, the fastening mechanism 52 enables a simple dismantling of the ejector 10 into the nozzle string 34 and the sleeve 46 and also enables easy assembly of these parts. When the nozzle string 34 is being inserted into the sleeve 46, the position and orientation of the check valves 82 and 84 relative to the nozzle string 34 does not alter either, as was described previously.

What is claimed is:

1. A multistage ejector, comprising:

a nozzle arrangement having at least three nozzles arranged in series in a direction of a longitudinal axis, the nozzles adapted to provide passage of a through-flow of a fluid, a fluid gap being provided between adjacent nozzles, at least two of the at least three nozzles are interconnected monolithically to form a nozzle string, a sleeve including an inside and an outside, the sleeve having a first radial opening and a second radial opening opposing the first radial opening, wherein the first and second radial openings are each configured to pass from the inside of the sleeve to the outside of the sleeve, the nozzle string being arranged at least partially in the sleeve;

a check valve for closing and freeing the first and second radial openings, the check valve including a slotted annular band having a first portion and a second portion extending circumferentially around the nozzle string, wherein the first and second portions are aligned with the first and second radial openings, respectively, and wherein the slotted annular band is connected monolithically via an axial tab to a discontinuous locking ring, the discontinuous locking ring including a slotted region configured to engage with a radial tongue in the nozzle string defining a rotational position of the check valve relative to the nozzle string, wherein the discontinuous locking ring is disposed between two spaced apart flanges for axially securing the check valve from displacement; and a fastening mechanism rotationally detachable and axially fastening the sleeve and the nozzle string to each other, the fastening mechanism being a positively locking fastening mechanism.

2. The ejector of claim 1, wherein the fastening mechanism fastens the nozzle string and the sleeve to each other in a rotationally secured manner relative to each other.

3. The ejector of claim 1, wherein the at least three nozzles comprise a driver nozzle and at least two receiver nozzles, wherein the at least two receiver nozzles form the monolithic nozzle string.

4. The ejector of claim 1, wherein the nozzle arrangement has at least four nozzles comprising a driver nozzle and at least three receiver nozzles, wherein the at least three receiver nozzles form the monolithic nozzle string.

5. The ejector of claim 1, wherein the fastening mechanism is a latching connection.

6. The ejector of claim 1, wherein the fastening mechanism is a combination of a plug-in and twist connection and a latching connection.

7. The ejector of claim 1, wherein the fastening mechanism is arranged on the nozzle string at a distance from an end of said nozzle string so that the nozzle string projects beyond the sleeve.

8. The ejector of claim 1, wherein the fastening mechanism has at least one radially projecting tongue on the nozzle string and at least one recess on the sleeve, the at least one recess extends parallel to the longitudinal axis, and the at least one recess adjoins a further recess on the sleeve which extends in a circumferential direction around the longitudinal axis.

9. The ejector of claim 1, wherein the nozzle string has a flange abutting against an end face of the sleeve when the nozzle string is being connected to the sleeve.

10. The ejector of claim 1, wherein the nozzle string includes the radial tongue integrally formed in and projecting radially outward from a center of the nozzle string and between free ends of the discontinuous locking ring, and wherein the radial tongue prevents rotation of the check valve around the longitudinal axis.

11. The ejector of claim 10, wherein the two spaced apart flanges are integrally formed on an outer side of the nozzle string forming a seat contacting at least one surface of the discontinuous locking ring.

12. The ejector of claim 1, wherein the fastening mechanism is a plug-in and twist connection.

13. The ejector of claim 12, wherein the fastening mechanism is a bayonet connection.

14. The ejector of claim 1, wherein two or more axial bridges are formed between each of the at least two of the at least three nozzles providing the monolithic interconnection.

15. The ejector of claim 14, wherein the two or more axial bridges are formed in the direction of the longitudinal axis of the nozzle arrangement.

16. The ejector of claim 15, wherein the two or more axial bridges are formed on peripheral surfaces of the at least two of the at least three nozzles.

17. The ejector of claim 16, wherein two axial bridges of the two or more axial bridges are disposed opposite one another radially about the fluid gap.

18. The ejector of claim 17, wherein the multistage ejector includes an inlet side disposed on a first end of the nozzle arrangement and an outlet side disposed on a second and opposite end of the nozzle arrangement, and wherein a portion of the two or more axial bridges connecting a first nozzle to a second nozzle in the nozzle string tapers outwardly from a peripheral surface of the first nozzle in a direction of the outlet side.

19. The ejector of claim 17, wherein a third axial bridge is disposed between the two axial bridges on one side.

20. The ejector of claim 19, wherein the check valve is axially offset from the fluid gap provided between adjacent nozzles in the nozzle string such that the check valve is not radially overlapping any portion of the fluid gap.

* * * * *